US008048288B2

(12) United States Patent
Sjong

(10) Patent No.: US 8,048,288 B2
(45) Date of Patent: Nov. 1, 2011

(54) IMPRESSED CURRENT PROTECTION FOR FOOD OR BEVERAGE CONTAINERS

(75) Inventor: Angele Sjong, Louisville, CO (US)

(73) Assignee: Empire Technology Development LLC, Wilmington, DE (US)

( * ) Notice: Subject to any disclaimer, the term of this patent is extended or adjusted under 35 U.S.C. 154(b) by 206 days.

(21) Appl. No.: 12/625,962

(22) Filed: Nov. 25, 2009

(65) Prior Publication Data

US 2011/0120884 A1 May 26, 2011

(51) Int. Cl.

| | |
|---|---|
| ***C23F 13/20*** | (2006.01) |
| ***C23F 13/06*** | (2006.01) |
| ***C23F 13/08*** | (2006.01) |
| ***C23F 13/12*** | (2006.01) |
| ***C23F 13/18*** | (2006.01) |

(52) U.S. Cl. ..... 205/737; 205/735; 205/738; 205/739; 205/740; 204/196.1; 204/196.37; 204/196.38

(58) Field of Classification Search ..... 205/735–740; 204/196.1, 196.37, 196.38

See application file for complete search history.

(56) References Cited

U.S. PATENT DOCUMENTS

| | | | |
|---|---|---|---|
| 1,958,765 | A | 5/1934 | Perkins |
| 2,941,935 | A | 6/1960 | Miller et al. |
| 3,281,008 | A | 10/1966 | D'Andrea |
| 4,013,811 | A | 3/1977 | Maruska |
| 4,195,006 | A | 3/1980 | Brown et al. |
| 4,202,750 | A | 5/1980 | Khoury |
| 5,728,275 | A | 3/1998 | Twigg |
| 6,540,886 | B1 | 4/2003 | Russell |
| 7,186,321 | B2 | 3/2007 | Benham |
| 2007/0036903 | A1 | 2/2007 | Mayr et al. |
| 2011/0123860 | A1* | 5/2011 | Sjong ..... 429/209 |

OTHER PUBLICATIONS

Suffet, I. H., "Advances in Taste-and-Odor Treatment and Control," American Water Works Research Foundation, 1995, p. 259.
Schachter, M., "The Importance of Magnesium to Human Nutrition," Schachter Center for Complemetary Medicine, 1996, 3 pages.
Doege, E. et al., "Sheet Metal Forming of Magnesium Wrought Alloys—Formability and Process Technology," Journal of Materials Processing Technology 115, 2001, pp. 14-19.
Schuyler, R., "Longevity: Anodes," WaterHeaterRescue.com, Nov. 9, 2005, 4 pages.
Bliss, R. M., "Lack Energy? Maybe It's Your Magnesium Level," Agricultural Research Magazine, May 4, 2004, 2 pages.
University of Maryland Medical Center, "Magnesium," Aug. 22, 2007, 5 pages.
Wester, P. O., "Magnesium," The American Journal of Clinical Nutrition, 1987, pp. 1305-1312, No. 45.
Wikipedia, "Cathodic Protection," Wikimedia Foundation, Inc., Jan. 23, 2004, 5 pages.

(Continued)

*Primary Examiner* — Bruce Bell
(74) *Attorney, Agent, or Firm* — Schwabe, Williamson & Wyatt, P.C.

(57) ABSTRACT

Techniques are generally described herein for protecting food or beverage containers (e.g., cans) using impressed current protection. In various embodiments, containers may be received into at least one conductive bed, each bed having a complementary anode. The containers may then be electrically coupled to a first terminal (e.g., negative) of a power supply, and the anode may be electrically coupled to a second terminal (e.g., positive) of the power supply. Resultantly, protective current may be provided to the containers by the anode. Other embodiments may be disclosed and claimed.

25 Claims, 4 Drawing Sheets

OTHER PUBLICATIONS

Davy, Sir H., "On the Corrosion of Copper Sheeting by Sea Water, and on Methods of Preventing This Effect; And on Their Application to Ships of War and Other Ships," Phil. Trans. R. Soc. Lond., Jan. 22, 1824, pp. 151-158.
Davy, Sir H., "Additional Experiments and Observations on the Application of Electrical Combinations to the Preservation of the Copper Sheathing of Ships, and to Other Purposes," Phil. Trans. R. Soc. Lond., Jun. 17, 1824, pp. 242-246.
Davy, Sir H., "Further Researches on the Preservation of Metals by Electrochemical Means," Phil. Trans. R. Soc. Lond., Jun. 9, 1825, pp. 328-346.
MPMA, "Protective and Decorative Coatings," Metal Packaging Manufacturers Association, 2008, 3 pages.
Brand, J.W.L.F. et al., "Impressed-current Anodes for the Application of Cathodic Protection," in Corrosion, by Sheir, L.L. et al., 1994, Section 10:3, pp. 56-92, 3rd Edition.
Jones, D. A., "Impressed Current Cathodic Protection," Principles and Prevention of Corrosion, 1996, pp. 442-444, 2nd Edition.
The Can Manufacturers Institute, Inc., "Monthly Metal Can Shipments Report 2005," Feb. 10, 2006, 9 pages.
CTV.ca News Staff et al., "U.S. Food Company Says BPA-free Cans Possible," CTVglobemedia, May 29, 2008, 1 page.
Food Standards Agency, "Bisphenol-A (BPA)," UK Government Department Information Sheet, Mar. 23, 2010, 2 pages.
Business Wire, "Metal Packaging Industry Welcomes FDA Statement on Bisphenol A (BPR)," Apr. 29, 2008, 2 pages.
Van Laack, R., "NRDC Citizen Petition Requests that FDA Prohibit All Use of Bisphenol A as a Food Additive," FDA Law Blog of Hyman, Phelps & McNamara, P.C., Dec. 18, 2008, 2 pages.
International Trade Centre UNCTAD/WTO, "Export Packaging Note No. 14: Technical Notes on the Use of Metal Cans," 30 pages.
Jacoby, M., "Carbon Nanotubes," Chemical & Engineering News, Dec. 17, 2008, 1 page.
Munguia-Lopez, E. et al., "Migration of Bisphenol A (BPA) from Epoxy Can Coatings to Jalapeno Peppers and an Acid Food Stimulant," Journal of Agricultural and Food Chemistry, Nov. 2002, pp. 7299-7302, No. 50.
Goodson, A. et al., "Migration of Bisphenol A from Can Coatings—Effects of Damage, Storage Conditions and Heating," Food Additives and Contaminants, Oct. 2004, pp. 1015-1026, vol. 21, No. 10.
Tsai, W.T., "Human Health Risk on Environmental Exposure to Bisphenol-A: A Review," Journal of Environmental Science and Health Part C, 2006, pp. 225-255.
Simal-Gandara, J. et al., "A Critical Review of the Quality and Safety of Badge-Based Epoxy Coatings for Cans: Implications for Legislation on Epoxy Coatings for Food Contact," Critical Reviews in Food Science and Nutrition, 1998, pp. 675-688.
Montanari, A. et al., "Quality of Organic Coatings for Food Cans: Evaluation Techniques and Prospects of Improvements," Progress in Organic Coatings, 1996, pp. 159-165, No. 29.
Ben-Jonathan, N. et al., "Xenoestrogens: The Emerging Story of Bisphenol A," Trends Endocrinol. Metab., 1998, pp. 124-128, vol. 9, No. 3.
Oldring, P. et al., "Packaging Materials: 7. Metal Packaging for Foodstuffs," ILSI Europe, Sep. 2007, 44 pages.
ICIS.com, "Abbreviations," Aug. 28, 2006, 1 page.
Plastics News, "Panel Blasts FDA Stance on BPA's Safety," Crain Communications, Nov. 3, 2008, 2 pages.
International Search Report and Written Opinion, issued in International Patent Application No. PCT/US2010/058038, mailed Jan. 18, 2011, 9 pages.
International Search Report and Written Opinion, issued in International Patent Application No. PCT/US2010/058057, mailed Jan. 20, 2011, 15 pages.

* cited by examiner

IMPRESSED CURRENT PROTECTION FOR FOOD OR BEVERAGE CONTAINERS

RELATED APPLICATION

This application is related to Ser. No. 12/626,017, entitled "Enclosing Manufacture with a Magnesium Sacrificial Anode for Corrosion Protection," filed contemporaneously Nov. 25, 2009.

BACKGROUND

Bisphenol A (BPA)-based phenolic epoxy coatings can be used to protect steel and aluminum food/beverage cans from corrosion. Overtime, BPA may be released into the food/beverage. There may be health concerns over the release.

Non-can steel structures exposed to corrosive conditions for extended period of time have been cathodically protected. Typically, the potential of the steel surface may be polarized (pushed) more negative until the surface has a uniform potential. At that stage, the driving force for the corrosion reaction may be reduced or halted. An impressed current cathodic protection system may protect steel by converting alternating current (AC) to direct current (DC). For example, a pipeline protection system may include an AC power rectifier with a maximum rated DC output of between 10 and 50 amperes and 50 volts. The positive DC output terminal may be connected via cables to an array of anodes (often inert graphite) buried in the ground (the anode grounded). For many applications, the anodes are installed in a 60 m (200 foot) deep, 25 cm (10-inch) diameter vertical hole and backfilled with conductive coke.

BRIEF DESCRIPTION OF THE DRAWINGS

Subject matter is particularly pointed out and distinctly claimed in the concluding portion of the present Specification. The foregoing and other features of the present disclosure will become more fully apparent from the following Description and appended Claims, taken in conjunction with the accompanying Drawings. Understanding that these Drawings depict only example embodiments in accordance with the present disclosure and are, therefore, not to be considered limiting of its scope. The disclosure will be described with additional specificity and detail through use of the accompanying Drawings:

DETAILED DESCRIPTION

Figure 1:
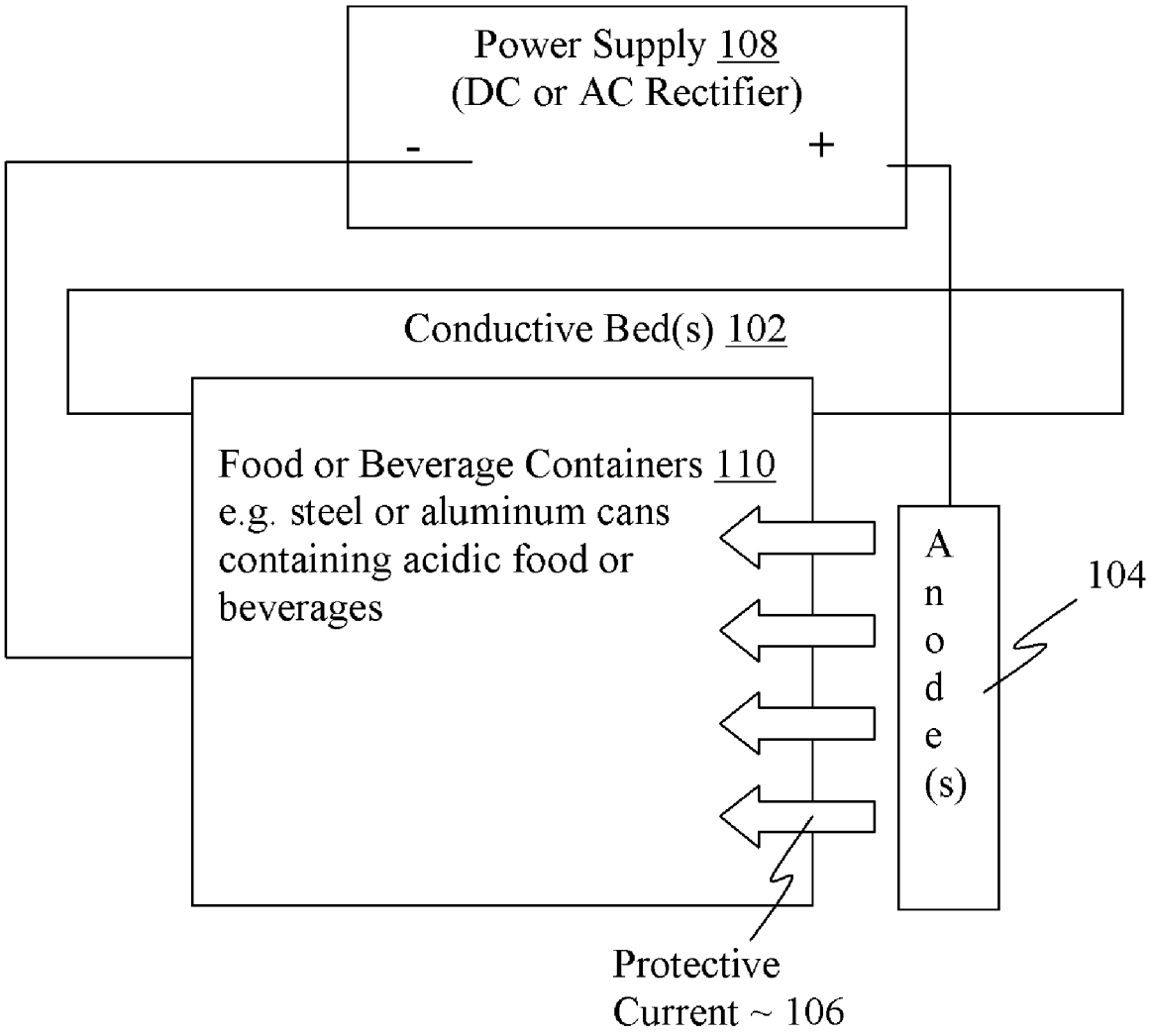
FIG. 1 is a block diagram illustrative of an overview of impressed current protection for food or beverage containers.

The following description sets forth various examples along with specific details to provide a thorough understanding of claimed subject matter. It will be understood by those skilled in the art, however, that claimed subject matter may be practiced without some or more of the specific details disclosed herein. Further, in some circumstances, well-known methods, procedures, systems, components and/or circuits have not been described in detail in order to avoid unnecessarily obscuring claimed subject matter. In the present Detailed Description, reference is made to the accompanying Drawings, which form a part hereof. In the Drawings, similar symbols typically identify similar components, unless context dictates otherwise. The illustrative embodiments described in the Detailed Description, Drawings, and Claims are not meant to be limiting. Other embodiments may be utilized, and other changes may be made, without departing from the spirit or scope of the subject matter presented here. It will be readily understood that the aspects of the present disclosure, as generally described herein, and illustrated in the Drawings, may be arranged, substituted, combined, and designed in a wide variety of different configurations, all of which are explicitly contemplated and make part of this disclosure.

Techniques are generally described herein for protecting food or beverage containers (e.g., cans) using impressed current protection. In various embodiments, containers may be received into at least one conductive bed, each conductive bed having a complementary anode. The containers may then be electrically coupled to a first terminal of a power supply (e.g., negative), and the anode may be electrically coupled to a second terminal (e.g., positive) of the power supply. Resultantly, protective current may be provided to the containers by the anode, as described further below. Other embodiments may be disclosed and claimed.

Referring now to FIG. 1, which is a block diagram illustrative of impressed current protection for food or beverage containers, according to embodiments of the present disclosure. As illustrated, food or beverage containers 110 may be received by conductive bed(s) 102 having complementary anode(s) 104. In turn, food or beverage containers 110 may be electrically coupled to a terminal of a power supply 108, e.g., the negative terminal, and anode(s) 104 may be electrically coupled to the other terminal of power supply 108, e.g., the positive terminal. Resultantly, by virtue of the reactions at cathode (container exterior) and anodes, anodes (104) may provide protective current 106 to food or beverage containers 110

Reaction at cathode (reduction) (container exterior) may be characterized by the chemical equation:

$$2H_2O+O_2+4e^-=4OH \quad (1)$$

whereas, reaction at anode (oxidation) may be characterized by the chemical equation:

$$2H_2O=O_2+4H^++4e^- \quad (2)$$

That is, at cathode, the moisture ($2H_2O$) and oxygen ($O_2$) present on the container exterior may combine with 4 electrons ($4e^-$) to reduce and form hydroxyl ion (4OH) on the container exterior (Equation (1)). Whereas, at anode, moisture ($2H_2O$) may be formed on the container exterior by oxidation of the oxygen ($O_2$) and hydrogen ($4H^+$) present on the container exterior (Equation (2)).

In various embodiments, food or beverage containers 110 may be steel or aluminum cans designed to can various food or beverages, including but not limited to acidic food or beverages, such as tomatoes, grapefruit juices, and so forth. For steel or aluminum cans, the cans may have a coating to protect the food or beverage, or no coating. In various embodiments, power supply 102 may be a DC power supply as illustrated. In alternate embodiments, power supply 102 may be a rectifier converting AC power supply to DC power supply. Embodiments of conductive bed(s) 102 and anode(s)

104 will be further describe below, including arrangements formed, and associated methods, referencing the remaining Figs.

In various embodiments, a pallet of containers is provided with cathodic polarization of about 120 mv. At that voltage level, correction rate of steel or aluminum containers may be reduced by as much as three (3×) orders of magnitude.

Figure 2:
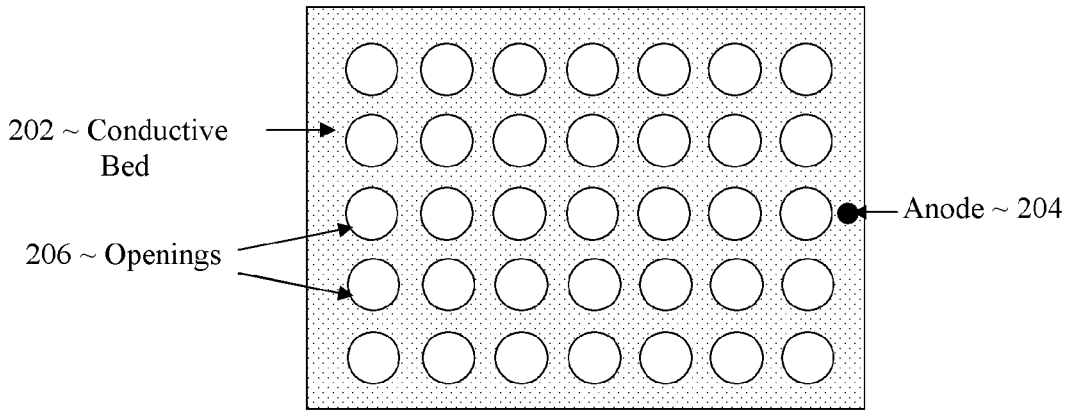
FIG. 2 illustrates a conductive bed with an anode.

FIG. 2 illustrates a conductive bed with an anode, arranged according to at least some embodiments of the present disclosure. For the illustrated embodiments, conductive bed 202 may be provided with a number of openings 206 for receiving the containers. In various embodiments, openings 206 may have different dimensions to accommodate different size containers. For the embodiments, conductive bed 202 may also be coupled with anode 204, at a side of conductive bed 202 as shown. As further described below, additional anodes 204 may be employed and coupled with conductive bed 202.

In various embodiments, conductive bed 202 may be reusable. In various embodiments, conductive bed 202 may be constituted with a material of calcined coke breeze. In various embodiments, the thickness of conductive bed 202 may vary, depending on the structural strength, if any, desired. In alternate embodiments, other materials with similar structural and/or electrical properties may be employed instead. In various embodiments, conductive bed 202 may also be provided with a coating of a woven, porous jacket.

In various embodiments, anode 204 may be constituted with an inert material of graphite or platinum coated titanium. In various embodiments, the dimension of anode 204 may vary, depending on the amount or strength of protective current desired. The amount or strength of protective current desired may be dependent on the size and material of the containers. In alternate embodiments, other materials with similar structural and/or electrical properties may be employed instead. In various embodiments, anode 204 may also be coated with a conductive polymer. Coating anode 204 with a conductive polymer may reduce the number anodes required for an application.

Figure 3:
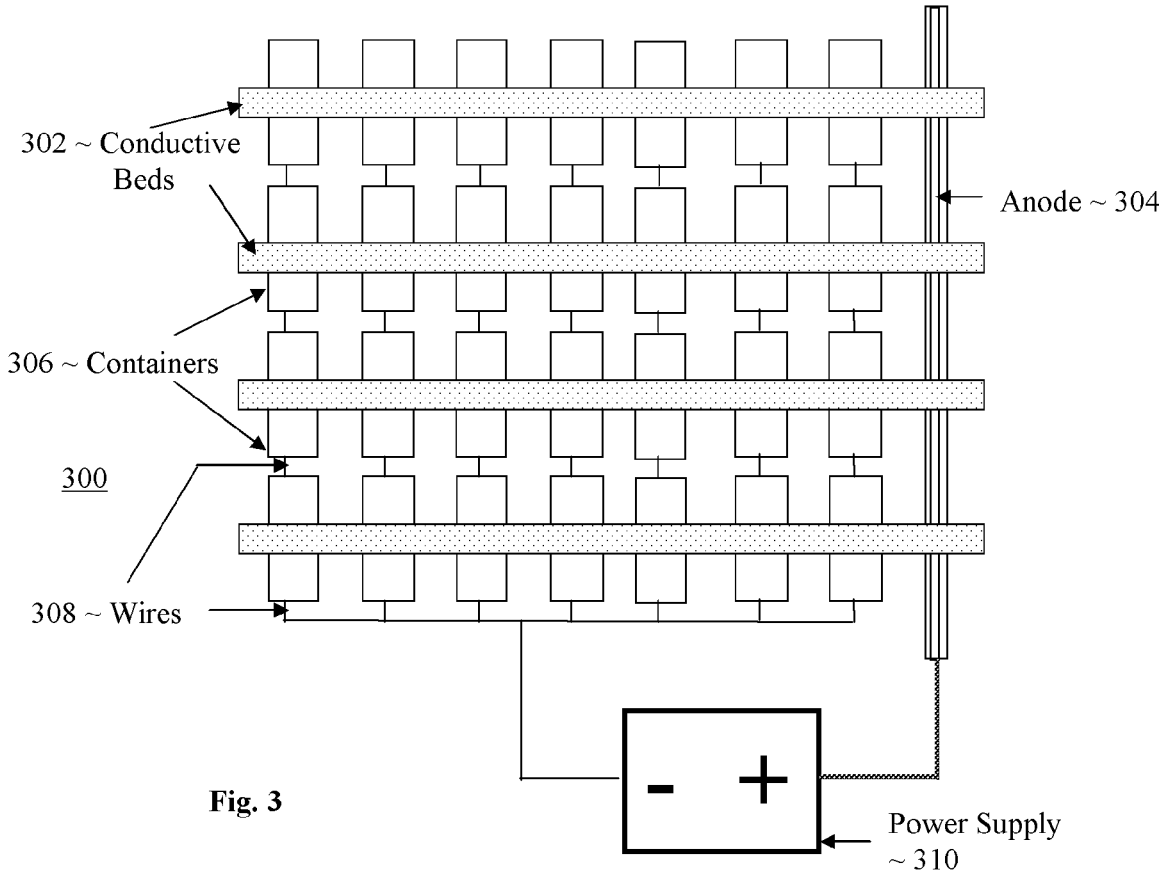
FIG. 3 illustrates an arrangement of conductive beds with anode.

FIG. 3 illustrates an arrangement of conductive beds with an anode, arranged according to at least some embodiments of the present disclosure. As illustrated, for the embodiments, arrangement 300 may include a number of conductive beds 302. Conductive beds 302 may be provided with a number of openings, constituted with materials, and/or coated, as earlier described for conductive bed 202. Conductive beds 302 may be vertically arranged with a vertical spacing between adjacent beds. In various embodiments, the vertical spacing may be configured to allow wires 308 be used to electrically couple containers 306 to one of the terminals of power supply 310, e.g., the negative terminal, as shown. Wires 308 may be electrically coupled to containers 306 in any one or a number of manners, e.g., by wrapping wires 308 around containers 306, or taping wires 308 to containers 306. In various embodiments, containers 306 of adjacent beds 302 may be electrically coupled to each other, via other arrangements. For example, in various embodiments, the vertical spacing may be configured to be the thickness of a metal sheet, to allow the received containers 306 of adjacent beds 302 to be electrically coupled to each other, using a metal sheet. The thickness of the metal sheets may vary depending on the size and/or weight of the containers. In various embodiments, the vertical spacing may be configured to be virtually non-existing, to allow the received containers 306 of adjacent beds 302 to touch, and thereby electrically coupled to each other, and in turn to one of the e terminals of power supply 310 instead.

Figure 4:
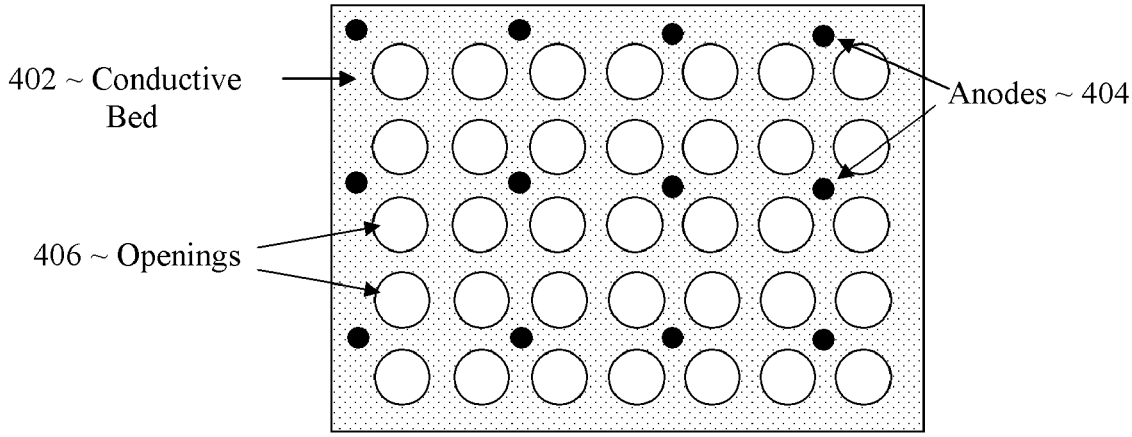
FIG. 4 illustrates another conductive bed with anodes.

FIG. 4 illustrates another conductive bed with anodes, arranged according to at least some embodiments of the present disclosure. For the illustrated embodiments, conductive bed 402 may be provided with a number of openings 406 for receiving the containers. In various embodiments, similar to openings 206, openings 406 may have different dimensions to accommodate different size containers. For the embodiments, conductive bed 402 may also be provided with a number of anodes 404, disposed on conductive bed 402 as shown. Except for anodes 404, conductive bed 402 may be otherwise constituted with materials, and coated, as earlier described for conductive bed 202.

Figure 5:
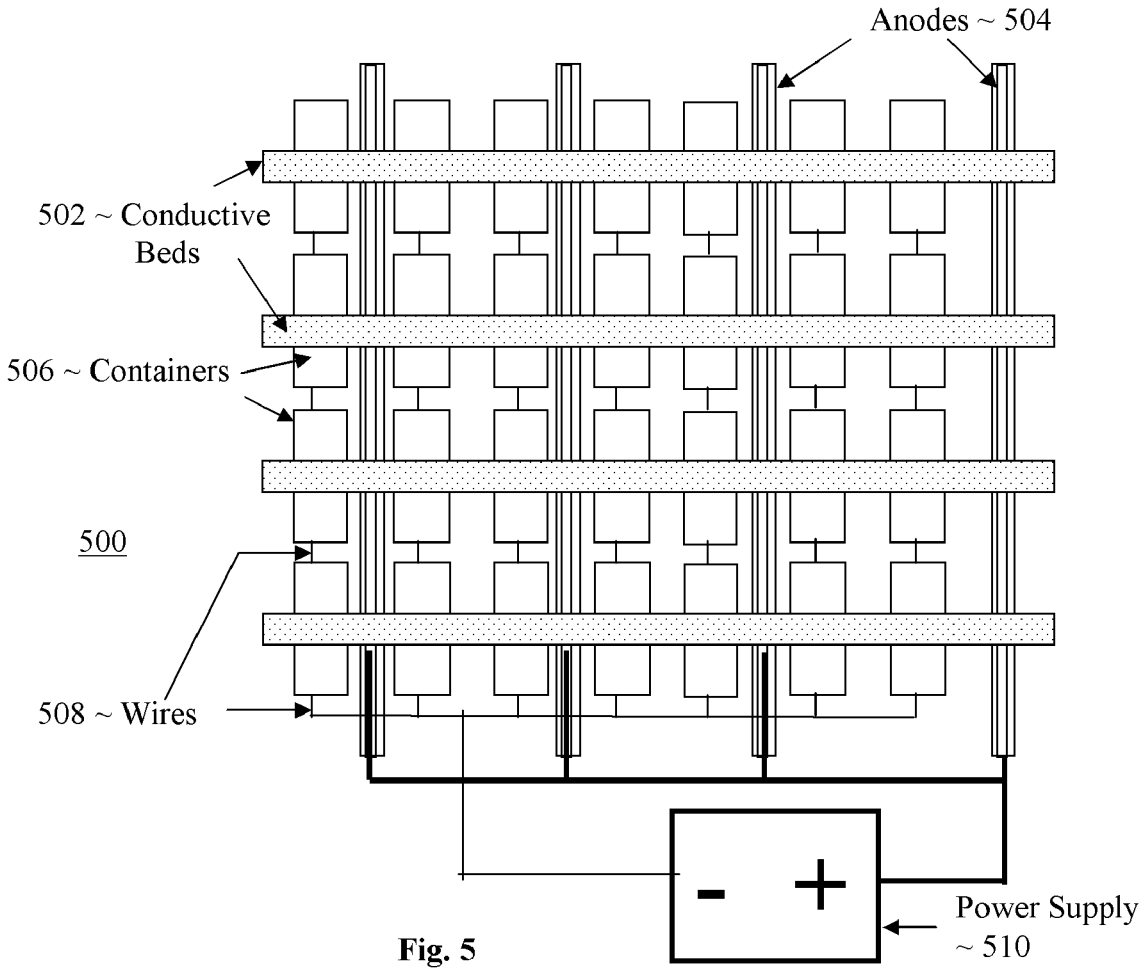
FIG. 5 illustrates another arrangement of conductive beds with anodes.

FIG. 5 illustrates another arrangement of conductive beds with anodes, arranged according to at least some embodiments of the present disclosure. Arrangement 500, includes a number of conductive beds 502 and anodes 504. Similar to arrangement 300, wires 508 are employed to electrically couple containers 506 and anode 504 to power supply 510 to allow anodes 504 to provide protect current to containers 506. Likewise, in alternate embodiments, conductive beds 502 may be vertically arranged with a vertical spacing or virtually no vertical spacing to allow received containers 506 of adjacent beds 502 be physically and electrically coupled instead, as earlier described.

Figure 6:
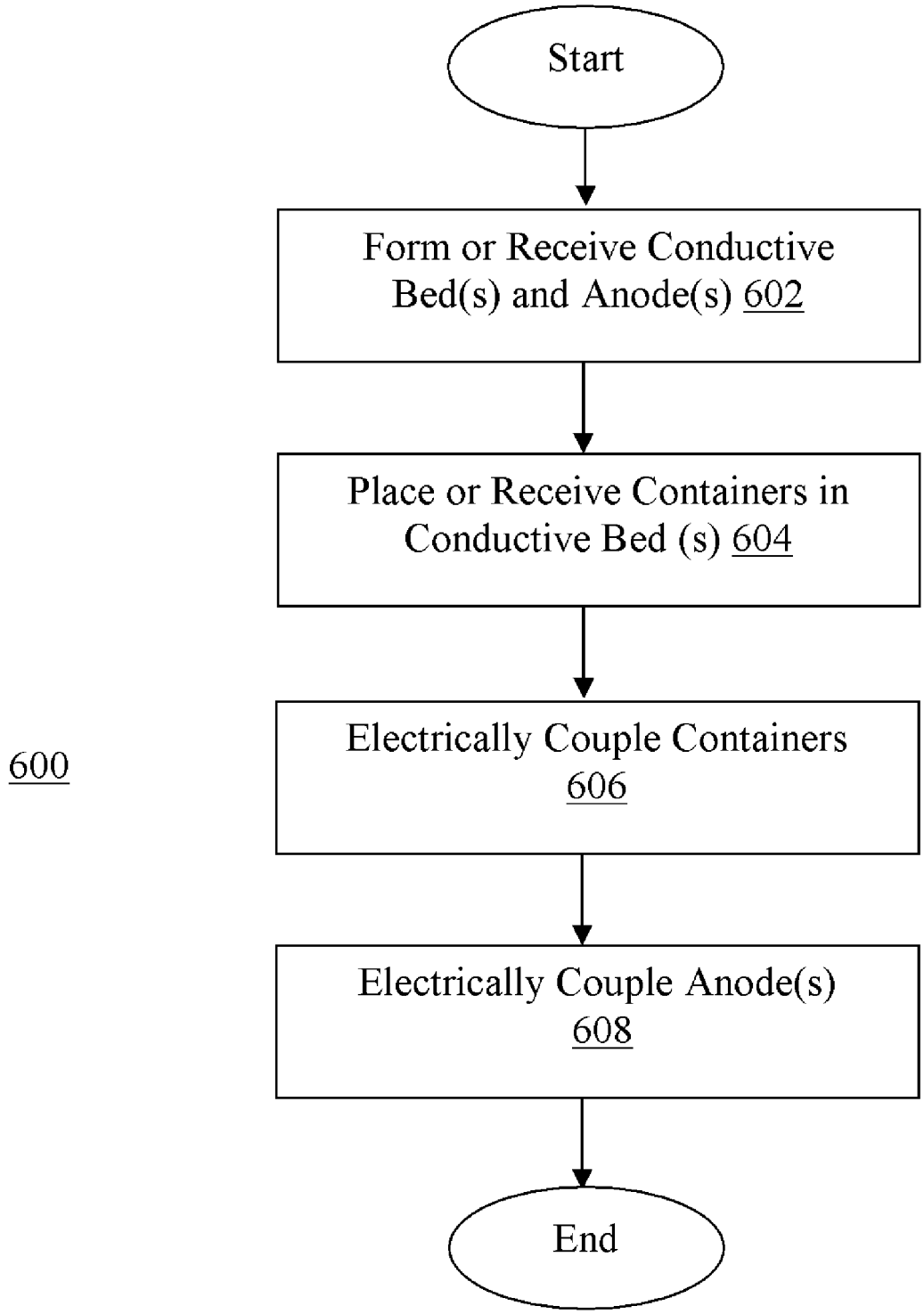
FIG. 6 illustrates a method of impressed current protection for food or beverage containers, all arranged in accordance with various embodiments of the present disclosure.

FIG. 6 illustrates a method of impressed current protection for food or beverage containers, according to at least some embodiments of the present disclosure. Method 600 may include one or more operations, functions or actions as illustrated by blocks 602, 604, 606, and/or 608. Method 600 may start at block 602, "Form or Receive Conductive Bed(s) with Anode(s)." At block 602, a practitioner of the present disclosure, e.g. a manufacturer or a bottler, may form or receive the earlier described embodiments of conductive beds, anode and/or arrangements of the conductive beds with anode(s). From block 602, method 600 may proceed to block 604, "Place or Receive Containers in Conductive Bed(s)." At block 604, a practitioner of the present disclosure, e.g. a bottler, a grocer, or a food/beverage establishment operator, may place containers into, or receive containers placed in the earlier described embodiments of conductive beds, anode and/or arrangements of the conductive beds with anode(s).

From block 604, method 600 may proceed to block 606, "Electrically Couple Containers." At block 606, a practitioner of the present disclosure, e.g. a bottler, a grocer, or a food/beverage establishment operator, may electrically couple the containers to one of the terminals of a power supply, e.g., the negative terminal. In some embodiments, the coupling may include keeping an end of a wire in contact with a container by e.g. wrapping around, taping or otherwise secure the end of the wire to the container. In other embodiments, the coupling may include electrically coupling containers in adjacent conductive beds. From block 606, method 600 may proceed to block 608, "Electrically Couple Anode(s)." At block 608, a practitioner of the present disclosure, e.g. a bottler, a grocer, or a food/beverage establishment operator, may electrically couple the anode(s) to the other terminal of the power supply, e.g., the positive terminal, thereby enabling protective current to be provided from the anodes to the containers.

Claimed subject matter is not limited in scope to the particular implementations described herein. In the current description, various aspects of claimed subject matter below have been described. For purposes of explanation, specific numbers, systems and/or configurations were set forth to provide a thorough understanding of claimed subject matter. However, it should be apparent to one skilled in the art and having the benefit of this disclosure that claimed subject matter may be practiced without the specific details. In other instances, well-known features were omitted and/or simplified so as not to obscure claimed subject matter. While certain features have been illustrated and/or described herein, many modifications, substitutions, changes and/or equivalents will now, or in the future, occur to those skilled in the art. It is, therefore, to be understood that the appended claims are intended to cover all such modifications and/or changes as fall within the true spirit of claimed subject matter.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While certain example techniques have been described and shown herein using various methods, devices and systems, it should be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter also may include all implementations falling within the scope of the appended claims, and equivalents thereof.

What is claimed is:

1. A method for protecting a plurality of containers of food or beverages with impressed current provided by a power supply, the method comprising:

electrically coupling the plurality of containers to a first terminal of the power supply, wherein each of the plurality of container are located in a corresponding opening of a conductive bed; and electrically coupling an anode associated with a conductive bed to a second terminal of the power supply, wherein a conductive path for the impressed current is formed between the first terminal and the second terminal through at least a portion of the plurality of containers.

2. The method of claim 1, wherein electrically coupling the plurality of containers comprises electrically coupling a subset of the plurality of containers placed in one conductive bed to another subset of the plurality of containers placed in another conductive bed.

3. The method of claim 1, further comprising electrically coupling another anode associated with the conductive bed to the second terminal of the power supply.

4. The method of claim 1, further comprising placing the containers into openings of at least one conductive bed.

5. The method of claim 1, wherein electrically coupling a plurality of containers comprises electrically coupling a plurality of steel or aluminum containers.

6. A method for protecting a plurality of containers of food or beverages with impressed current provided by a power supply, the method comprising:

receiving at least one conductive bed having a plurality of openings and at least one anode; and placing a plurality of containers into corresponding openings of the at least one conductive bed, to enable the containers to be protected during storage, when the containers are electrically coupled to a first terminal of a power supply, and the at least one anode is coupled to a second terminal of the power supply, wherein a conductive path for the impressed current is formed between the first terminal and the second terminal through at least a portion of the plurality of containers.

7. The method of claim 6, further comprising electrically coupling the containers to the first terminal of the power supply, and the at least one anode to the second terminal of the power supply.

8. A method for protecting a plurality of containers of food or beverages with impressed current provided by a power supply, the method comprising:

forming at least one conductive bed having a plurality of openings configured to receive a plurality of containers of food or beverages, with a material comprising calcined coke breeze;

coating the at least one conductive bed with a woven and porous jacket; and providing at least one anode for the at least one conductive bed, to enable a conductive path for the impressed current to be formed between a first terminal and a second terminal of the power supply, when the containers are electrically coupled to the first terminal of the power supply, and the at least one anode is coupled to the second terminal of the power supply.

9. The method of claim 8, wherein providing at least one anode comprises:

forming the at least one anode with an inert material of graphite or platinum coated titanium; and coating the at least one anode with conductive polymer.

10. A method for protecting a plurality of containers of food or beverages with impressed current provided by a power supply, the method comprising:

forming at least one anode with an inert material of graphite or platinum coated titanium; and coating the at least one anode with conductive polymer;

wherein the at least one anode is configured to be used with at least one conductive bed having a plurality of openings to receive a plurality of containers, wherein a conductive path for the impressed current is formed between a first terminal and a second terminal of the power supply through at least a portion of the plurality of containers, when the portion of the containers are electrically coupled to the first terminal of the power supply, and the at least one anode is electrically coupled to the second terminal of the power supply.

11. An apparatus for protecting a plurality of containers of food or beverages with an impressed current provided by a power supply, the apparatus comprising:

at least one conductive bed configured to receive a plurality of containers; and at least one anode configured to be electrically coupled to a first terminal of a power supply, wherein a conductive path for the impressed current is formed between the first terminal and a second terminal through at least a portion of the plurality of containers, when the containers are electrically coupled to the second terminal of the power supply.

12. The apparatus of claim 11, wherein the at least one conductive bed comprises a plurality of openings configured to receive the containers.

13. The apparatus of claim 11, wherein the at least one conductive bed comprises a material of calcined coke breeze.

14. The apparatus of claim 13, wherein a conductive bed is further coated with a woven, porous jacket.

15. The apparatus of claim 11, wherein the at least one anode comprises an inert material of graphite or platinum coated titanium.

16. The apparatus of claim 15, wherein the at least one anode further comprises a coating of a conductive polymer.

17. The apparatus of claim 11 further comprising a plurality of wires configured to electrically couple the containers to each other or to the second terminal of the power supply.

18. The apparatus of claim 11 further comprising the power supply, wherein the power supply is elected one of a DC power supply or a rectifier configured to convert AC power into DC power.

19. An apparatus for protecting a plurality of containers of food or beverages with an impressed current provided by a power supply, the apparatus comprising:

a conductive bed configured to receive the plurality of containers, wherein the conductive bed comprises:

a plurality of openings to receive the containers;

material of calcined coke breeze; and, a coating of woven, porous jacket; and, wherein the conductive bed is configured to be used with at least one anode to provide impressed current protection to the containers when the containers are electrically coupled to a first terminal of the power supply, and the at least one anode is electrically coupled to a second terminal of the power supply.

20. The apparatus of claim 19, further comprising the at least one anode, wherein an anode is constituted with an inert material of graphite or platinum coated titanium, and coated with a conductive polymer.

21. An apparatus for protecting a plurality of containers of food or beverages with an impressed current provided by a power supply, the apparatus comprising:

at least one anode, wherein an anode is constituted with an inert material of graphite or platinum coated titanium, and coated with a conductive polymer, and wherein the least one anode is configured to be used with at least one conductive bed to provide the impressed current protection to containers placed in the at least one conductive bed, when the containers are electrically coupled to a first terminal of the power supply, and the at least one anode is electrically coupled to a second terminal of the power supply.

22. The apparatus of claim 21, wherein the at least one conductive bed comprises a plurality of openings to receive the containers.

23. An apparatus for protecting containers of food or beverages, the apparatus comprising:

a plurality of conductive beds arranged in a first direction, wherein each conductive bed comprises a plurality of openings to receive the containers, a material of calcined coke breeze, and a coating of woven, porous jacket; and a plurality of anodes arranged in a second direction orthogonal to the first direction, and configured to be coupled to a positive terminal of a power supply to provide protective current to the containers, when the containers are electrically coupled to a negative terminal of the power supply, wherein an anode comprises an inert material of graphite or platinum coated titanium and a coating of a conductive polymer, and passes through the plurality of conductive beds.

24. The apparatus of claim 23 further comprising a plurality of wires to electrically couple the containers to each other or to the negative terminal of the power supply.

25. The apparatus of claim 23, further comprising the power supply, wherein the power supply comprises a selected one of a DC power supply or a rectifier configured to convert AC power into DC power.

* * * * *

UNITED STATES PATENT AND TRADEMARK OFFICE

CERTIFICATE OF CORRECTION

PATENT NO. : 8,048,288 B2
APPLICATION NO. : 12/625962
DATED : November 1, 2011
INVENTOR(S) : Sjong It is certified that error appears in the above-identified patent and that said Letters Patent is hereby corrected as shown below:

On the Title Page, in Field (56), under "OTHER PUBLICATIONS", in Column 2, Line 4, delete "Complemetary" and insert -- Complementary --, therefor.

In Fig. 6, Sheet 4 of 4, in Box "604", in Line 2, delete "Bed (s)" and insert -- Bed(s) --, therefor.

In Column 2, Line 41, delete "110" and insert -- 110. --, therefor.

In Column 8, Line 11, in Claim 17, delete "11" and insert -- 11, --, therefor.

In Column 8, Line 14, in Claim 18, delete "11" and insert -- 11, --, therefor.

In Column 8, Line 46, in Claim 21, delete "the least" and insert -- the at least --, therefor.

In Column 9, Line 6, in Claim 24, delete "23" and insert -- 23, --, therefor.

Signed and Sealed this
Eighth Day of May, 2012

David J. Kappos

David J. Kappos
*Director of the United States Patent and Trademark Office*